US007473893B2

(12) United States Patent
Lopez-Avila et al.

(10) Patent No.: US 7,473,893 B2
(45) Date of Patent: Jan. 6, 2009

(54) ICP/ESI MASS SPECTROMETRY SYSTEMS AND METHODS OF USE THEREOF

(75) Inventors: Viorica Lopez-Avila, Sunnyvale, CA (US); Ganqiang Li, Palo Alto, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 281 days.

(21) Appl. No.: 11/581,141

(22) Filed: Oct. 13, 2006

(65) Prior Publication Data

US 2008/0087817 A1 Apr. 17, 2008

(51) Int. Cl.
*H01J 49/10* (2006.01)

(52) U.S. Cl. ..... 250/288; 250/423 R; 204/603; 204/452

(58) Field of Classification Search ..... 250/288, 250/423 R; 204/603, 452
See application file for complete search history.

(56) References Cited

U.S. PATENT DOCUMENTS 5,597,467 A * 1/1997 Zhu et al. ..... 204/603
6,126,086 A * 10/2000 Browner et al. ..... 239/102.1

* cited by examiner

*Primary Examiner*—Kiet T Nguyen

(57) ABSTRACT

Briefly described, embodiments of this disclosure include mass spectrometry systems and methods of performing molecular mass spectrometry and elemental mass spectrometry using a single mass spectrometry system.

22 Claims, 2 Drawing Sheets

ICP/ESI MASS SPECTROMETRY SYSTEMS AND METHODS OF USE THEREOF

BACKGROUND

Metallomics, the comprehensive analysis of all metal species within a cell or tissue, and metalloproteomics, the study of the part of metallome that involves the protein ligands, heteroatom-tagged proteomics are emerging areas in speciation analysis in bioinorganic chemistry for clinical research and pharmaceutical research. In such analytical studies, both elemental (e.g., metallic) and molecular information of an analyte needs to be investigated.

Currently, the analytical techniques for this type of research typically use several different methods and instruments, either separately or in certain combination. For instance, inductively coupled plasma mass spectrometry (ICP-MS) is used for metal detection and the electrospray ionization (ESI) or matrix assisted laser desorption/ionization mass spectrometry (MALDI-MS) is used for identification of the biomolecules.

The ICP has been a powerful tool for analytical chemistry since it was introduced as an atomic emission source for optical spectrometry in the 1960's. In the ICP, radio frequency electrical energy is continuously coupled via a spiral load coil into an inert gas flow stream at atmospheric pressure. In a typical design, argon flows through a plasma torch made of three concentric quartz tubes (e.g., U.S. Pat. No. 3,958,883) and placed within a spiral coil. The central gas flow usually referred to as the carrier gas flow because it is used to carry the sample to be ionized or excited. An intermediate gas flow, termed the auxiliary flow, is needed for confining the hot carrier gas and cooling. The outermost flow, termed the coolant gas, both sustains the plasma and protects the quartz tube from melting due to the high temperature in the plasma.

The electromagnetic field induced by the radio frequency energy (e.g., 27 MHZ or 40 MHZ) sustains a plasma in the gas. The plasma contains free electrons, ions, and excited atoms and molecules. A chemical sample, usually in a form of aerosol droplets, is introduced into the carrier gas stream through the central quartz tube into the plasma. The aerosol sample is vaporized and decomposed to atoms and small molecules, due to the high temperature of the plasma. Some of the atoms and molecules of the sample are further excited and ionized by the free electrons.

ICP-MS is widely accepted for its isotope specificity, multi-element capability, high sensitivity, wide dynamic range (i.e., about 9 orders of magnitude), and the fact that the signal intensity is independent of the molecular structure of the protein and sample matrix.

ESI-MS has proven to be very valuable in system biology and genomic studies since provides information on the protein identification. However, ESI-MS is strongly compound dependent and often suppressed by the presence of the matrix. When the information generated by the two techniques is combined it has been shown to help with the identification of metalloproteins and their functions at the molecular level.

Because of the complexity of the human serum, a multidimensional separation, such as high performance liquid chromatography (HPLC) is usually employed prior to mass spectrometric detection. In conventional methods, the effluent of a chromatographic column is then either split between the ICP-MS and the ESI-MS systems, or fractions are collected and chromatographed again under a different set of operating conditions prior to electrospray MS. In both cases, at least two mass spectrometers are needed, which increases costs and maintenance. The setup is complicated and sample analysis is very time consuming.

Therefore, there is a need in the art to address the aforementioned deficiencies and shortcomings.

SUMMARY

Briefly described, embodiments of this disclosure include mass spectrometry systems and methods of performing molecular mass spectrometry and elemental mass spectrometry using a single mass spectrometry system. One exemplary mass spectrometry system, among others, includes: an integrated ionization source, wherein the integrated ionization source includes an inductively coupled plasma (ICP) ionization source and an electrospray ionization (ESI) source.

Another exemplary method of mass spectrometry system, among others, includes: a mass spectrometer interface disposed adjacent an integrated ionization source, wherein the integrated ionization source includes an inductively coupled plasma (ICP) ionization source and an electrospray ionization (ESI) source. The ICP ionization source includes an inner tube, a middle tube, and an outer tube. The inner tube includes a capillary tube disposed therein for sample introduction. The volume of the inner tube not occupied by the capillary tube allows a first gas to flow from a first end to a second end of the inner tube. The middle tube allows a second gas to flow from a first end to a second end of the middle concentric tube. The inner tube is disposed within the middle tube. The outer tube allows a third gas to flow from a first end to a second end of the outer tube. The middle tube is disposed within the outer tube. A spiral load coil is disposed around the second end of the outer tube. A radio frequency power source is in communication with to the spiral load coil. The ESI source includes the capillary tube. The ESI source is operative to generate a potential difference across the capillary tube and the mass spectrometer interface.

One exemplary method of performing molecular mass spectrometry and elemental mass spectrometry using a single mass spectrometry system, among others, a mass spectrometry system as described herein having a single mass analyzer; introducing a sample to the capillary tube; applying an RF power to the spiral load coil to generate a plasma; introducing the sample to the plasma to produce a plurality of ions; mass analyzing the ions with the single mass analyzer; turning off the RF power to the spiral load coil; electrospraying the sample from the capillary to produce ions; and mass analyzing the ions with the single mass analyzer.

Additional objects, advantages, and novel features of this disclosure shall be set forth in part in the descriptions and examples that follow and in part will become apparent to those skilled in the art upon examination of the following specifications or can be learned by the practice of the disclosure. The objects and advantages of the disclosure can be realized and attained by means of the instruments, combinations, compositions and methods particularly pointed out in the appended claims.

BRIEF DESCRIPTION OF THE DRAWINGS

Reference is now made to the following drawings. Note that the components in the drawings are not necessarily to scale.

DETAILED DESCRIPTION

Figure 1:
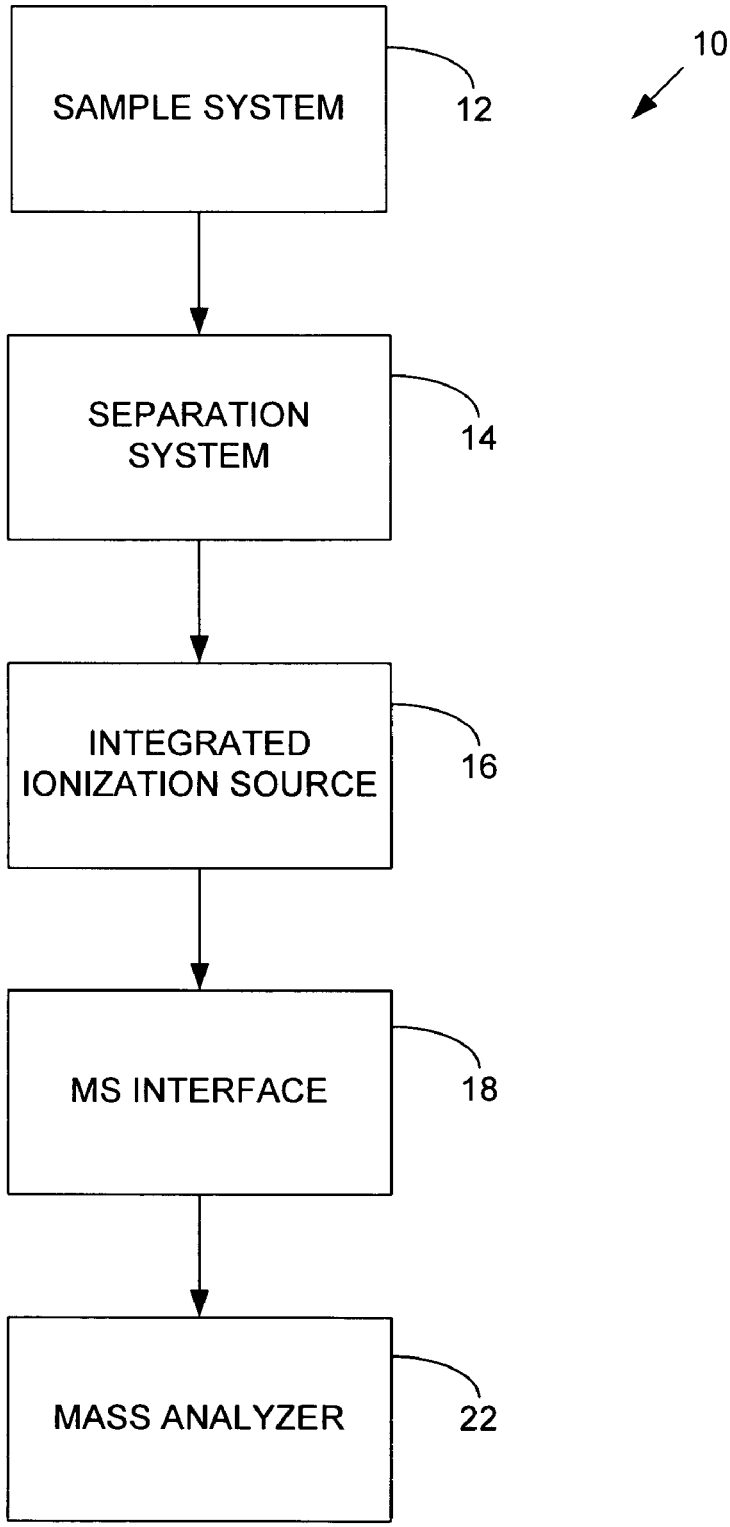
FIG. 1 illustrates a block diagram of an embodiment of a mass spectrometry system.

Embodiments of the present disclosure will employ, unless otherwise indicated, techniques of chemistry, biochemistry, molecular biology, spectroscopy, liquid chromatography, and the like, that are within the skill of the art. Such techniques are explained fully in the literature.

The following examples are put forth so as to provide those of ordinary skill in the art with a complete disclosure and description of how to perform the methods and use the compositions disclosed and claimed herein. Efforts have been made to ensure accuracy with respect to numbers (e.g., amounts, temperature, etc.) but some errors and deviations should be accounted for. Unless indicated otherwise, parts are parts by weight, temperature is in ° C., and pressure is at or near atmospheric. Standard temperature and pressure are defined as 20° C. and 1 atmosphere.

Before the embodiments of the present disclosure are described in detail, it is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an" and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

Discussion

Embodiments of the present disclosure include mass spectrometry systems and methods of use thereof. The mass spectrometry system includes an integrated ionization source. The integrated ionization source includes an inductively coupled plasma (ICP) ionization source and an electrospray ionization (ESI) source. The integrated ionization source is interfaced with a single mass analyzer.

The mass spectrometry system can be used to analyze various types of samples such as, but not limited to, biological samples, serum samples, protein samples, and the like. In particular, mass spectrometry system can be used to analyze metalloprotein samples. The integrated ionization source is configured to operate as an ICP ionization source when operated in a "RF on" mode, and is configured to operate as an ESI source when operated in a "RF off" mode. The "RF on" mode can be used to perform elemental analysis, while the "RF off" mode can be used to perform molecular analysis. At least one advantage of the mass spectrometry system is that a single integrated ionization source can be used to perform molecular and elemental analysis. A further benefit is that only a single mass analyzer is needed to perform the molecular and elemental analysis.

In contrast, current technologies for metallomic and metalloproteomics studies require splitting up a sample and analyzing the two portions separately with two mass spectrometry systems (an ESI-MS and an ICP-MS). The configuration and set-up needed to analyze the sample is complicated, time consuming, and costly. Embodiments of the present disclosure can analyze samples without splitting the sample and using a much less expensive and complicated system (e.g., a single mass analyzer). By eliminating the complexity of the previous systems, embodiments of the present disclosure should find application in many studies such as metallomic and metalloproteomics studies. The presence of a covalently bound metal ion or other heteroatom makes ICP-MS very attractive for elemental analysis and quantitative work, while ESI-MS retains its identification power at the molecular level.

ICP-MS is a mass dependent detector and interfacing it with capillary HPLC would be beneficial because of both increased transport of the analyte to the plasma and increased ionization efficiency in the plasma because of the decreased flow rate that is being used in capillary HPLC. The reduced flow rate also makes possible use of acetonitrile and other organic solvents as mobile phases in HPLC, which are quite compatible with embodiments of the present disclosure.

FIG. 1 illustrates a block diagram of an embodiment of a mass spectrometry system 10. The mass spectrometry system 10 includes, but is not limited to, a sample system 12, a separation system 14, an integrated ionization source 16, a mass spectrometry interface 18, and a mass analyzer 22. A sample is introduced to the separation system 14 from the sample system 12. In an embodiment the sample can include, but is not limited to, metalloproteins. The metals or metalloids can be determined in the "RF on" mode, while the protein can be determined in the "RF off" mode.

The separation system 14 can include, but is not limited to, a liquid chromatograph system (e.g., HPLC), an electrophoresis system (e.g., CE), ion chromatograph (IC), and a gas chromatograph (GC). The liquid chromatograph system can include, but is not limited to, a column (e.g., Zorbax SB C3, 0.3 mm i.d.×150 mm length×3.5 μm particles).

The separation system 14 is interfaced with a capillary tube (additional details in FIG. 2) of the integrated ionization source 16. The sample flows through the capillary tube. In the "RF on" mode, a sufficient RF power (e.g., about 800 Watts to 1500 Watts) is applied to a coil (additional details in FIG. 2) disposed on a portion of the integrated ionization source 16 to generate a plasma in a portion of the integrated ionization source 16 adjacent the coil. The sample exits the capillary tube and is entrained into a gas and flowed into the plasma. The RF field generated by the coil excites a gas (e.g., Ar atoms), enabling a high-energy plasma to be sustained. The sample aerosol is swept into the plasma, where it is desolvated, atomized, and/or ionized to form sample ions. The mass spectrometer interface 18 is disposed adjacent the integrated ionization source 16. The mass spectrometer interface 18 is in communication with the mass analyzer 22. The ions generated by the plasma can flow through the mass spectrometer interface 18, into the mass analyzer 22, and subsequently detected.

In the "RF off" mode, a potential difference (e.g., about 2000 to 4000 volts) is generated between a capillary tube (that is electrically conductive) disposed in the integrated ionization source 16 and the mass spectrometer interface 18. The sample passes through the capillary tube. The sample is electrosprayed from the capillary tube and compounds in the sample are ionized. The ions can flow through the mass spectrometer interface 18, into the mass analyzer 22, and subsequently mass analyzed.

The mass spectrometer interface 18 separates the atmospheric pressure region present in the integrated ionization source 16 from the low-pressure (e.g., $10^{-5}$ torr) region of the mass analyzer 22. The mass spectrometer interface 18 can include, but is not limited to, a sampling plate, a skimmer plate, electrostatic ion lenses, and a radiofrequency multipole ion guide. In an embodiment, the sampling plate includes a small diameter (e.g., 0.5 to 2 mm i.d.) orifice that separates the mass spectrometer interface 18 from the mass analyzer 22. A portion of the ions generated can pass through the orifice. A voltage can be applied to the skimmer plate to attract the ions to the orifice. In addition, the mass spectrometer interface 18 includes, but is not limited to, one or more vacuum pumps and other vacuum equipment. In an embodiment, an electrostatic lens system can be used to guide and/or focus the ions. Vacuum systems and ion focusing systems are known to those skilled in the art.

The mass analyzer 22 can include, but is not limited to, a time-of-flight (TOF) mass analyzer system, a quadrupole (Q) mass analyzer system, a Q-TOF mass analyzer system, an ion trap mass analyzer system (IT-MS), an ion cyclotron resonance mass analyzer system (e.g., FTICR-MS), and an orbitrap system. An ion detector can be disposed adjacent the mass analyzer to detect the ions. The ion detector can include, for example, a faraday cup detector (with or without phase sensitive detection), a microchannel plate multiplier detector, an electron multiplier detector, or a combination thereof. The mass analyzer 22 can include appropriate electronic systems, vacuum systems, and the like.

Figure 2:
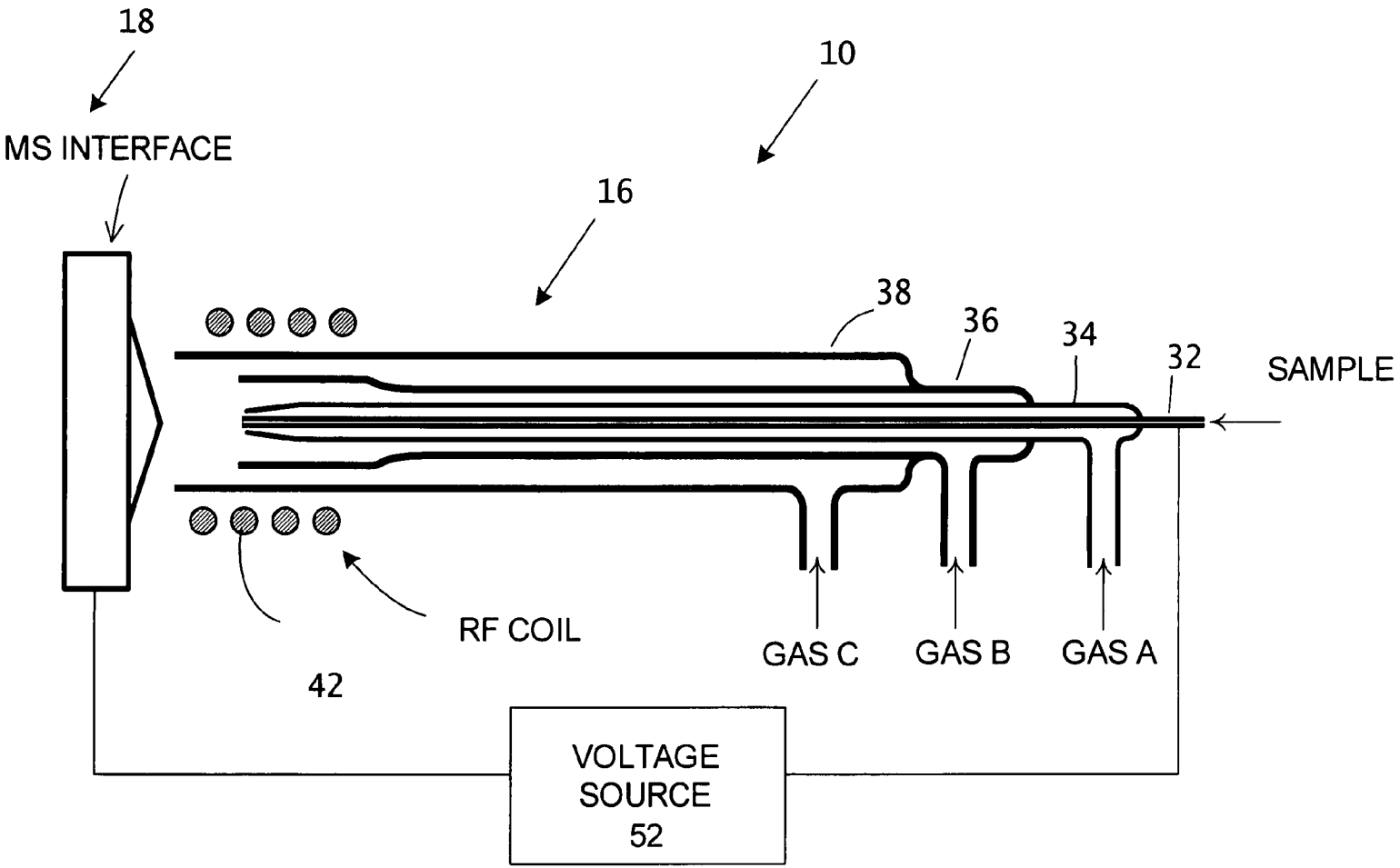
FIG. 2 illustrates a cross-section of an embodiment of an integrated ionization source disposed adjacent a mass spectrometer interface.

FIG. 2 illustrates a cross-section of an embodiment of an integrated ionization source 16 disposed adjacent a mass spectrometer interface 18. The integrated ionization source 16 includes, but is not limited to, a capillary tube 32, an inner tube 34, a middle tube 36, and an outer tube 38. Each of the capillary tube 32, the inner tube 34, the middle tube 36, and the outer tube 38 has a first end and a second end, where the second end is closest to the mass spectrometer interface 18.

In an embodiment, the capillary tube 32 is concentrically located within the inner tube 34. The inner tube 34 is concentrically located within the middle tube 36. The middle tube 36 is concentrically located within the outer tube 38. In another embodiment, additional tubes can be used to flow one or more gases.

A sample can be flowed through the capillary tube 32. The sample can be flowed at a rate of about 20 nL/min to 100 μL/min. Gas "A" can be flowed through inner tube 34. Gas "B" can be flowed through middle tube 36. Gas "C" can be flowed through outer tube 38.

Gas "A" can be referred to as the make-up gas and/or nebulization gas. Gas "A" can include, but is not limited to, argon, helium, nitrogen and combinations thereof. Gas "A" can be flowed at a rate of about 0.3 to 3 L/min.

Gas "B" can be referred to as the auxiliary gas, which are known in the art. Gas "B" can be flowed at a rate of about 0.1 to 2 L/min and typically about 1 L/min.

Gas "C" can be referred to as the cooling gas. Gas "C" can include, but is not limited to, Ar and the like. Gas "C" can be flowed at a rate of about 10 to 20 or about 12 to 15 L/min.

Each of the inner tube 34, the middle tube 36, and the outer tube 38 can be independently made of materials such as, but not limited to, quartz, glass, ceramic, and combinations thereof.

The inner tube 34 can have a length of about 50 to 200 mm. The inner tube 34 can have a diameter of about 3 to 6 mm. The middle tube 36 can have a length of about 50 to 200 mm. The middle tube 36 can have a diameter of about 5 to 8 mm. The outer tube 38 can have a length of about 50 to 200 mm. The outer tube 38 can have a diameter of about 8 to 20 mm.

The capillary tube 32 can be made of a conductive material or a non-conductive material. The conductive material can include materials such as, but not limited to, stainless steel, metalized polymers, metalized glass, or quartz. The non-conductive materials can include materials such as, but not limited to, quartz, glass, or ceramic. The length of the capillary tube 32 can be from about 50 to 200 mm. However, the length depends, in part, upon the length of the inner tube 34, the middle tube 36, and the outer tube 38. The diameter of the capillary tube 32 can be about 1 to 2 mm. A voltage potential can be applied to the capillary tube 32 (e.g., a conductive capillary tube) or through the sample flowing through the capillary tube 32 in the "RF off" mode via a voltage source 52. In an embodiment, the capillary tube 32 can be heated. )

A RF coil 42 is disposed around a portion of the second end of the outer tube 38. RF power can be applied to the RF coil 42 to generate a plasma within a portion of the integrated ionization source 16 under appropriate ICP conditions in the "RF on" mode.

As described briefly above, a sample from the separation system flows into the capillary tube of the integrated ionization source. The sample traverses the length of the capillary tube. The integrated ionization source can be operated in the "RF on" mode for elemental analysis or in the "RF off" mode for molecular analysis.

In the "RF on" mode, a radiofrequency current is sent through the RF coil such that a plasma is generated in a portion of the integrated ionization source adjacent the coil and the exit of the capillary tube. The sample exits the capillary tube and is entrained into a gas and flowed into the plasma. The plasma desolvates, atomizes, and/or ionizes the sample to form sample ions. The mass spectrometer interface is disposed adjacent the integrated ionization source. The ions are attracted to the mass spectrometer interface and pass through an orifice in the mass spectrometer interface. The ions enter the mass analyzer and are detected.

In the "RF off" mode, the radiofrequency power is turned off and a voltage difference is generated between the capillary tube disposed in the integrated ionization source and the mass spectrometer interface. The sample is electrosprayed from the capillary tube and compounds in the sample are ionized. The ions are attracted to the mass spectrometer interface and pass through an orifice in the mass spectrometer interface. The ions enter the mass analyzer and are detected.

It should be noted that ratios, lengths, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited.

Many variations and modifications may be made to the above-described embodiments. All such modifications and variations are intended to be included herein within the scope of this disclosure and protected by the following claims.

All patents, patent applications, and publications mentioned herein are hereby incorporated by reference in their entireties.

What is claimed is:

1. A mass spectrometry system comprising:

a mass spectrometer interface disposed adjacent an integrated ionization source, wherein the integrated ionization source includes an inductively coupled plasma (ICP) ionization source and an electrospray ionization (ESI) source:

wherein the ICP ionization source includes an inner tube, a middle tube, and an outer tube, wherein the inner tube includes a capillary tube disposed therein for sample introduction, wherein the volume of the inner tube not occupied by the capillary tube allows a first gas to flow from a first end to a second end of the inner tube, wherein the middle tube allows a second gas to flow from a first end to a second end of the middle concentric tube, wherein the inner tube is disposed within the middle tube, wherein the outer tube allows a third gas to flow from a first end to a second end of the outer tube, wherein the middle tube is disposed within the outer tube, wherein a spiral load coil is disposed around the second end of the outer tube, wherein a radio frequency power source is in communication with to the spiral load coil; and wherein the ESI source includes the capillary tube, wherein the ESI source is operative to generate a potential difference across the capillary tube and the mass spectrometer interface.

2. The mass spectrometry system of claim 1, wherein the integrated ionization source is operative in an ICP mode upon activation of the spiral load coil and wherein the integrated ionization source is operative in an ESI mode when the spiral load coil is not activated and a potential difference is applied across the capillary tube and the mass spectrometer interface.

3. The mass spectrometry system of claim 1, further comprising a single mass analyzer interfaced with the mass spectrometer interface, wherein the mass analyzer is selected from: time-of-flight (TOF) mass analyzer, quadrupole (Q) mass analyzer systems, Q-TOF, ion trap mass analyzer systems (IT-MS), ion cyclotron resonance a mass analyzer system (FTICR-MS), and orbitrap systems.

4. The mass spectrometry system of claim 3, wherein the mass analyzer includes a TOF mass analyzer.

5. The mass spectrometry system of claim 1, further comprising a separation system interfaced with the capillary tube.

6. The mass spectrometry system of claim 5, wherein the separation system is a liquid chromatography system.

7. The mass spectrometry system of claim 6, wherein the liquid chromatography system is a high performance liquid chromatography system.

8. The mass spectrometry system of claim 5, wherein the separation system is a capillary electrophoresis system.

9. The mass spectrometry system of claim 5, wherein the separation system is an ion chromatograph (IC).

10. The mass spectrometry system of claim 5, wherein the separation system is a gas chromatograph (GC).

11. The mass spectrometry system of claim 1, wherein the capillary tube is conductive.

12. The mass spectrometry system of claim 1, wherein the capillary tube is not conductive.

13. A method of performing molecular mass spectrometry and elemental mass spectrometry using a single mass spectrometry system comprising:

providing the mass spectrometry system of claim 1 having a single mass analyzer;

introducing a sample to the capillary tube;

applying an RF power to the spiral load coil to generate a plasma;

introducing the sample to the plasma to produce a plurality of ions;

mass analyzing the ions with the single mass analyzer;

turning off the RF power to the spiral load coil;

electrospraying the sample from the capillary to produce ions; and mass analyzing the ions with the single mass analyzer.

14. The method of claim 13, wherein the single mass analyzer is selected from: time-of-flight (TOF) mass analyzer, quadrupole (Q) mass analyzer systems, Q-TOF, ion trap mass analyzer systems (IT-MS), ion cyclotron resonance mass analyzer system (FTICR-MS), and orbitrap systems.

15. The method of claim 14, wherein the mass analyzer includes a TOF mass analyzer.

16. The method of claim 13, further comprising a separation system interfaced with the capillary tube.

17. The method of claim 16, wherein the separation system is a liquid chromatography system.

18. The method of claim 17, wherein the liquid chromatography system is a high performance liquid chromatography system.

19. The method of claim 16, wherein the separation system is a capillary electrophoresis system.

20. The method of claim 16, wherein the separation system is an ion chromatograph (IC).

21. The method of claim 16, wherein the separation system is a gas chromatograph (GC).

22. A mass spectrometry system comprising:

an integrated ionization source, wherein the integrated ionization source includes an inductively coupled plasma (ICP) ionization source and an electrospray ionization (ESI) source.

* * * * *

UNITED STATES PATENT AND TRADEMARK OFFICE

CERTIFICATE OF CORRECTION

PATENT NO. : 7,473,893 B2
APPLICATION NO. : 11/581141
DATED : January 6, 2009
INVENTOR(S) : Lopez-Avila et al.

It is certified that error appears in the above-identified patent and that said Letters Patent is hereby corrected as shown below:

In column 7, line 27, in Claim 3, after "resonance" delete "a".

Signed and Sealed this

Eleventh Day of August, 2009

David J. Kappos

David J. Kappos
*Director of the United States Patent and Trademark Office*